US005690309A

United States Patent [19]

Blum

[11] Patent Number: 5,690,309

[45] Date of Patent: Nov. 25, 1997

[54] REHABILITATION BOOK HOLDER

[76] Inventor: Edward I. Blum, 1713 Lincoln Rd., Champaign, Ill. 61821

[21] Appl. No.: 726,384

[22] Filed: Oct. 4, 1996

Related U.S. Application Data

[63] Continuation-in-part of Ser. No. 490,868, Jun. 15, 1995, abandoned.

[51] Int. Cl.[6] ..... A47B 97/04

[52] U.S. Cl. ..... 248/444; 248/451; 248/455

[58] Field of Search ..... 248/441.1, 444, 248/449, 451, 455, 188.5

[56] References Cited

U.S. PATENT DOCUMENTS

| | | | |
|---|---|---|---|
| 456,089 | 7/1891 | Harrison | 248/452 |
| 634,922 | 10/1899 | Waldrip | 248/452 |
| 702,307 | 6/1902 | Leuba | 248/444 |
| 716,128 | 12/1902 | Stedeker | 248/444 |
| 1,035,290 | 8/1912 | Wood | 248/444 |
| 1,476,545 | 12/1923 | Reaugh | 248/444 |
| 1,491,289 | 4/1924 | Clifford | 248/451 |
| 1,904,088 | 4/1933 | Schultz | 248/455 |
| 2,189,247 | 2/1940 | Johnson | 311/25 |
| 2,538,318 | 1/1951 | Mitchell | 248/455 X |
| 2,568,354 | 9/1951 | Moore | 248/455 X |
| 2,640,747 | 6/1953 | Bodenhoff | 248/444 |
| 2,863,256 | 12/1958 | Hegerty | 248/444 |
| 3,147,949 | 9/1964 | Webster | 248/444 |
| 3,463,438 | 8/1969 | Olson | 248/444 |
| 3,951,374 | 4/1976 | Quigley | 248/444 X |
| 4,295,624 | 10/1981 | Granada | 248/463 X |
| 4,404,915 | 9/1983 | Simpson | 108/43 |
| 4,537,646 | 8/1985 | Hoyle | 248/444 X |
| 4,702,453 | 10/1987 | Bishop | 248/452 X |
| 4,903,932 | 2/1990 | Stewart | 248/444 |
| 4,978,096 | 12/1990 | Struckman | 248/451 |
| 5,054,736 | 10/1991 | Champoux | 248/444 |
| 5,143,341 | 9/1992 | Juster | 248/444 |
| 5,165,648 | 11/1992 | Quigley | 248/444 |
| 5,263,423 | 11/1993 | Anderson | 248/444 X |

*Primary Examiner*—Carl D. Friedman
*Assistant Examiner*—Beth A. Aubrey
*Attorney, Agent, or Firm*—Don Moyer

[57] ABSTRACT

The book holder has a work surface with a shelf and straps so that a book and similar materials can be securely held on the work surface. The work surface has an adjustable leg and has a supportable surface which has an inflected curvature with positive curvature portions so that the work surface can be supported on the person using the book holder in positions ranging from the person's thigh to the person's upper body and so that, while supported in any of these positions, the work surface can be oriented about three orthogonal axes to suit the needs of the person and the work. The work surface has weighted ligaments which hold down pages of the book so that the pages can be turned with a mouth stick or commercial page turner.

14 Claims, 3 Drawing Sheets

FIG. 3
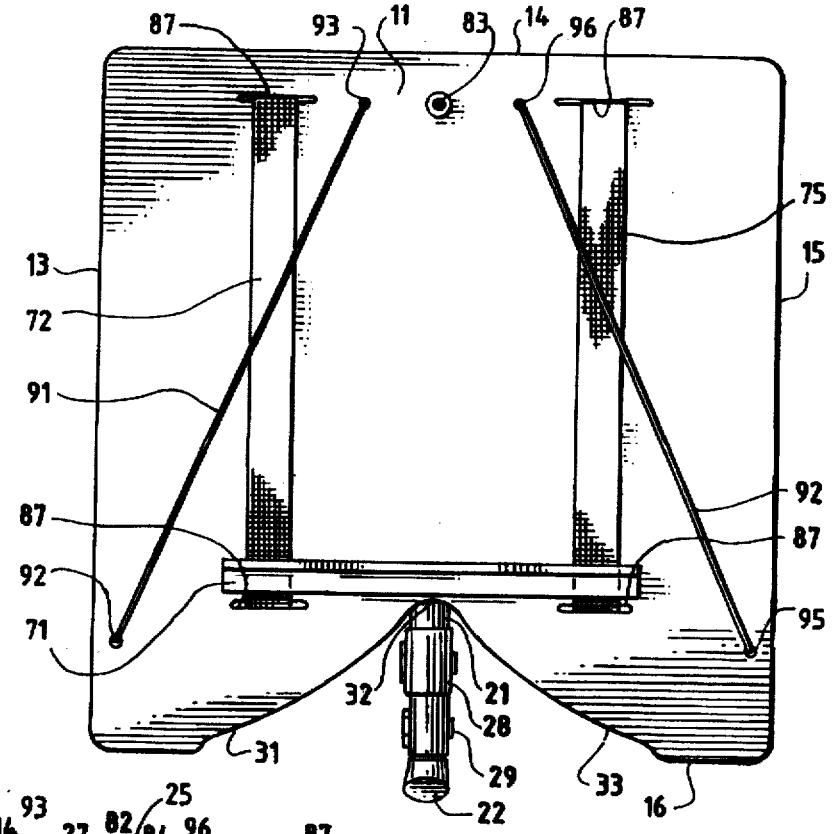
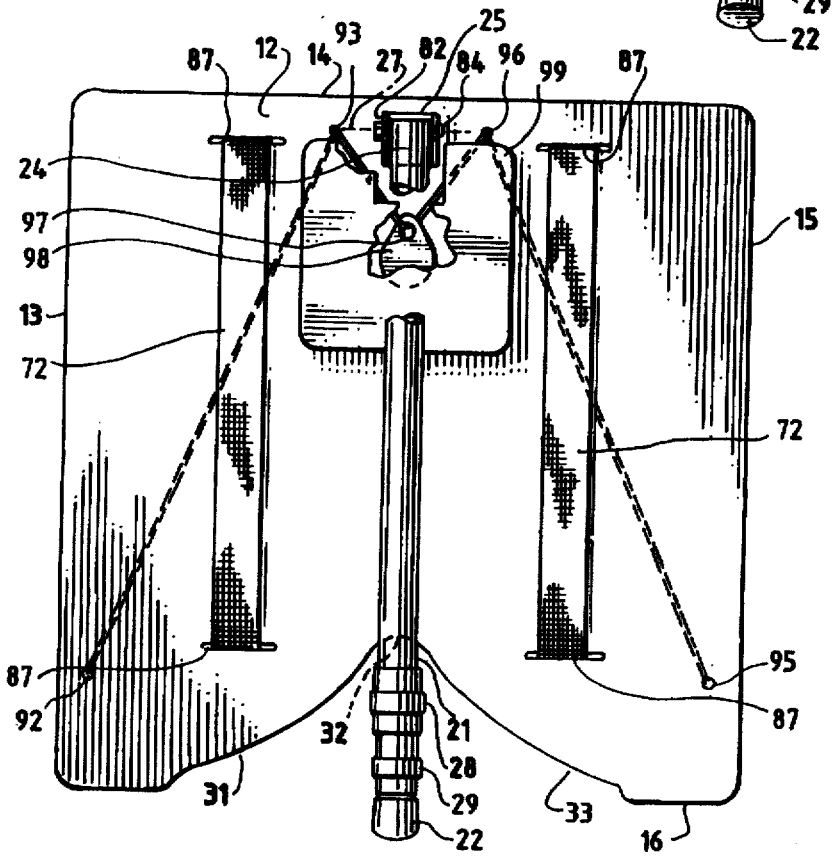
FIG. 4

FIG. 5
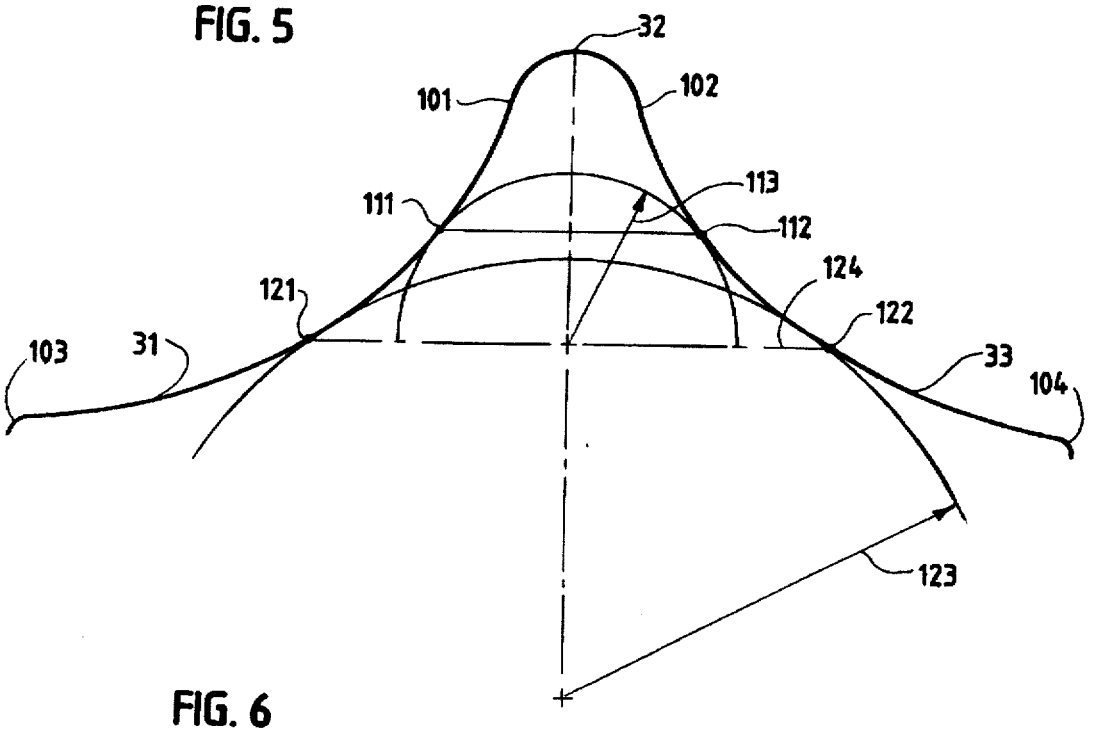
FIG. 6
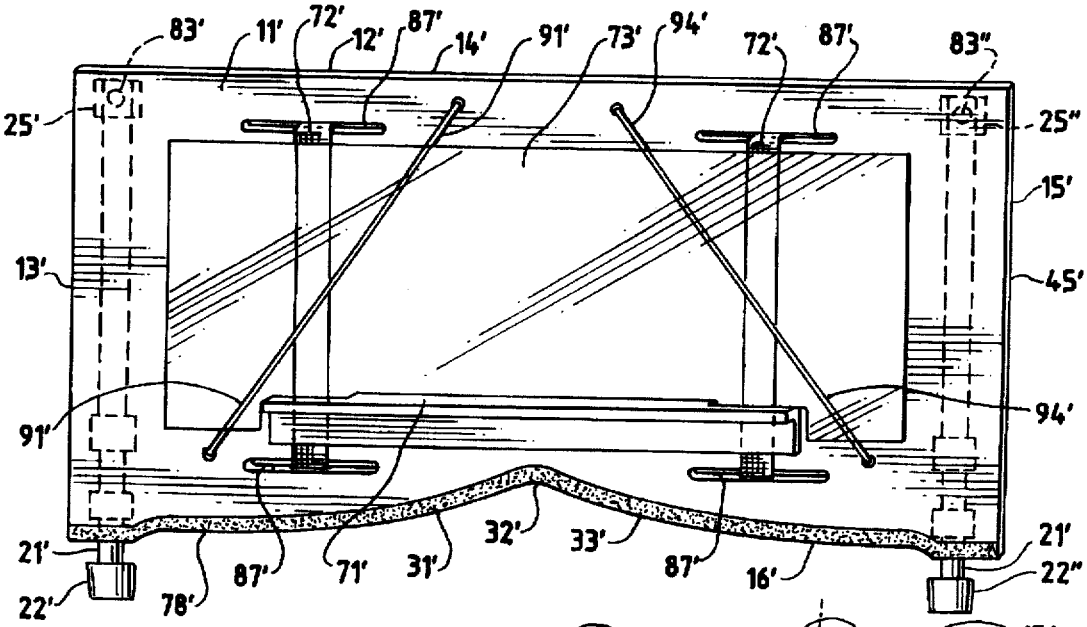
FIG. 7
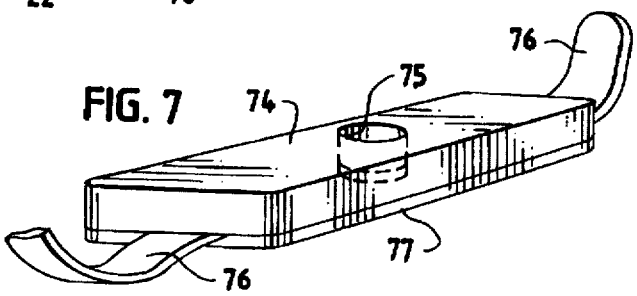
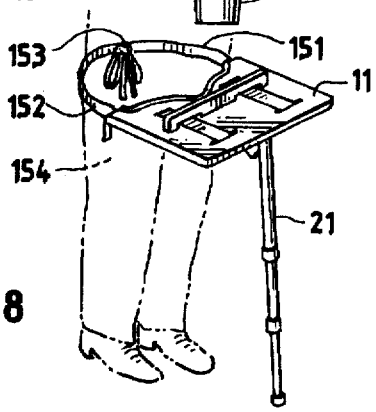
FIG. 8

REHABILITATION BOOK HOLDER

RELATED APPLICATIONS

This application is continuation-in-part of U.S. application Ser. No. 08/490,868 for "One Leg Easel" filed Jun. 15, 1995, now abandoned.

BACKGROUND

This invention is a device which can hold a book so that the book can be read by a person who has no use of their hands and arms, which can be stably supported in part on the person in various positions ranging from the person's thigh to the person's upper body, and which, in any of these support positions, can be oriented by rotation about three orthogonal axes to match the needs of the person and their work.

Persons with limited, or no, use of their hands and arms need a device which can hold a book, can hold paper for drawing and writing, and can hold other similar materials in order to enable the persons to use these materials. Holding a book is the most difficult requirement, especially given the ranges in size of books, so the device must be primarily a book holder which should also hold the other materials. Holding books, and paper for drawing and writing, and other similar materials for use by persons with no use of their hands is a necessary requirement even though the book holder also should be useful for persons with some, or full, use of their hands and arms. As well, the book holder must by useful for persons who have other requirements such as limited vision and such as working from a wheelchair. Persons must be able to use the book holder while seated in a chair, a wheelchair for example, and persons must be able to use the book holder while reclining and prone.

A person using the book holder will want to be able to rotate the book holder independently about three orthogonal axes in order to use the book holder in various seated and reclining positions and to orient the material on the book holder to the most useful position. For example, the person using the book holder will want to be able to orient the book holder to eliminate light glare from the materials on the book holder.

One way to make a book holder which can be useful in all these circumstances is to devise a book holder which has three points of support, located respectively at the vertices of a triangle, where two of the three support points are on the body of the person using the book holder and the third point of support is provided by an adjustable leg. Thus the book holder must be able to have two points of contact on a surface with a small radius of curvature, such as a persons thigh, and also must be able to have two other points of contact on a surface with a large radius of curvature, such as a persons upper body. This support condition is met by devising a supportable edge for the book holder which has an inflected curvature, the curvature being negative at the midpoint of the supportable edge, the curvature inflecting to positive curvature to the left of the midpoint, and the curvature inflecting to positive curvature to the right of the midpoint.

This inflected curvature is not suggested in any of the devices shown in prior art including: Harrison's U.S. Pat. No. 456,089, Waldrip's U.S. Pat. No. 634,922, Leuba's U.S. Pat. No. 702,307, Wood's U.S. Pat. No. 1,035,290, Reaugh's U.S. Pat. No. 1,476,545, Schutz's U.S. Pat. No. 1,904,088, Johnson's U.S. Pat. No. 2,189,247, Mitchell's U.S. Pat. No. 2,538,318, Moore's U.S. Pat. No. 2,568,354, Bodenhoff's U.S. Pat. No. 2,640,747, Hegerty's U.S. Pat. No. 2,863,256, Webster's U.S. Pat. No. 3,147,949, Granada's U.S. Pat. No. 4,295,624, Simpson's U.S. Pat. No. 4,404,915, Hoyle's U.S. Pat. No. 4,537,646, Bishop's U.S. Pat. No. 4,702,453, Champoux's U.S. Pat. No. 5,054,736, Quigley's U.S. Pat. No. 5,165,648, and Anderson's U.S. Pat. No. 5,263,423.

Thus, there is an opportunity for a new book holder with a supportable edge which has inflected curvature which can be supported on surfaces with a wide range of curvatures and which, when supported on any of these surfaces, can be oriented over a wide range by rotation about three orthogonal fixes.

SUMMARY

Objects of this invention include the following. Make a device which can hold a book so that the book can be read by a person with no use of their hands and arms. Make a book holder which also can hold paper for drawing and writing and can hold other similar materials. Make a book holder which is also useful for persons who have some, or full, use of their hands and arms and who may have other requirements such as limited vision and such as working from a wheelchair. Make a book holder which is supported at three points located respectively at the vertices of a triangle. Make a book holder with a supportable edge having an inflected curvature which has positive curvature portions which provide two of the three support points, which is thus supportable on surfaces with curvature ranging from that of a person's thigh to that of a person's upper body. Make the book holder which, while supported at any of these locations, is orientable over a wide range by rotation about three orthogonal axes. Make a book holder with a leg which can be adjusted in length and orientation. Make a book holder which has a shelf upon which the bottom of a book can be supported, has straps which can hold portions of the book, and has branches of a weighted ligament which can hold pages of the book. Make a book holder accessory which is an overlay which covers the straps and ligament branches to provide a smooth surface for drawing and writing. Make a book holder accessory which is a leg footer which can keep the leg from slipping on slippery surfaces. Make a book holder which has a high coefficient of friction at the supportable edge and is resilient at the supportable edge in order to cushion the supportable edge.

In Summary, one embodiment of this invention is a book holder having a work surface perpendicular to a normal axis, having a left edge and a right edge on a lateral axis, and having a top edge and a supportable edge on a long axis, the supportable edge having a midpoint and having an inflected curvature which is negative curvature at the midpoint and which inflects to be positive curvature to the left of the midpoint and inflects to be positive curvature to the right of the midpoint, the supportable edge also having a high coefficient of friction and also being resilient in order to cushion forces at the supportable edge, the book holder having an adjustable leg attached to the back surface, the work surface having a shelf and straps for holding books and the like on the work surface, the book holder having weighted ligaments for holding pages of books and the like, the book holder having an overlay for covering the straps and ligaments to provide a smooth surface for writing and the like, and the book holder having an accessory leg footer which can hold the foot end of the leg.

Other equivalent embodiments will be comprehended in the detailed description of the drawings, which will make additional equivalent embodiments obvious hereafter to persons skilled in the art.

BRIEF DESCRIPTION OF THE DRAWINGS

In the drawings:

FIG. 3 is a front view of the book holder.

FIG. 4 is a back view of the book holder.

FIG. 5 is a front view showing supportable portions of the book holder.

FIG. 6 is a front view showing an alternate version of the book holder.

FIG. 7 is a perspective view showing an accessory footer block.

FIG. 8 shows the book holder in use by a standing person.

DETAILED DESCRIPTION

Figure 1:
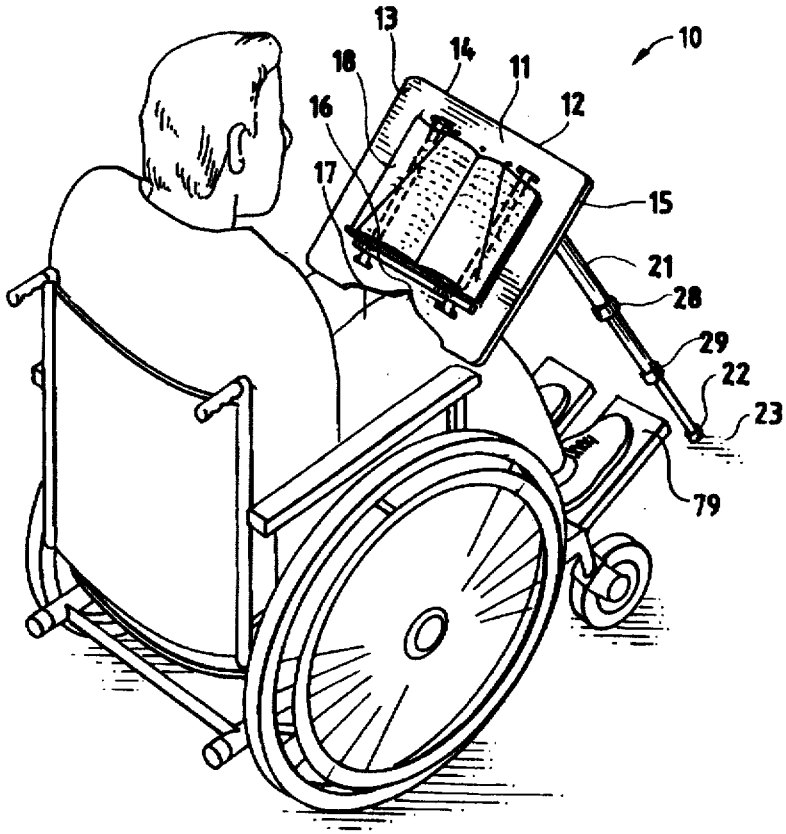
FIG. 1 shows the new book holder in use.
Figure 2:
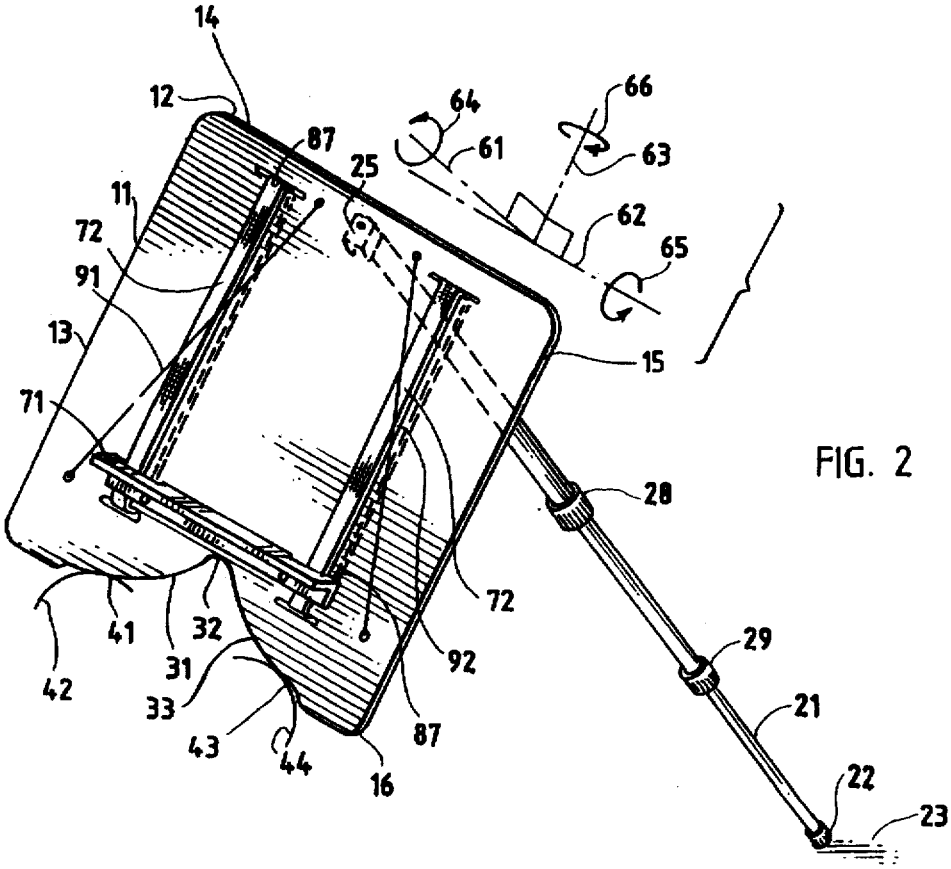
FIG. 2 is a perspective view showing elements of the book holder.

The new book holder 10 is shown in use by a person working from a wheelchair in FIG. 1. Here the book holder is supported on the person's thigh 17, and the book holder is holding a book 18. FIG. 2 shows that the book holder has a work surface 11 which has a back surface 12. The work surface and the back surface are bounded by a common periphery having a left edge 13, a top edge 14, a right edge 15, and a bottom edge 16 which is a supportable edge. The supportable edge 16 has a midpoint 32 where the supportable edge has negative curvature, inflects to a left portion 31 having positive curvature which is supportable at a left point 41 on a left portion of a supporting surface 42, and inflects to a right portion 33 having positive curvature which is supportable at a right point 43 on a right portion of the supporting surface 44. The left positive curvature and the right positive curvature portions are supported on the person's thigh in FIG. 1.

The work surface 11 is perpendicular to a normal axis 61, the left and right edges 13, 15 are on a lateral axis 62, and the top edge 14 and the midpoint 32 of the supportable edge 16 are on a long axis 63. While stably supported on a positive curvature surface such as a person's thigh or upper body, the work surface can be oriented about three orthogonal axes, for example rotated 64 about the normal axis 61, rotated 65 about the lateral axis 62, and rotated 66 about the long axis 63.

An adjustable length leg 21 is attached by a clevis joint 25 to the back surface 12. The leg has a foot end 22 which can be supported on an external footing surface 23. The external footing surface is usually a floor and can be other surfaces such as a foot rest on a wheelchair, a couch, and a bed. This allows the book holder to be supportable at three points, not in a line, which are thus located respectively at the vertices of a triangle 41, 43, 22. Three support points located respectively at the vertices of a triangle provide stable support. Because the inflected curvature of the supportable edge 16 has a left positive curvature portion 31 and has a right positive curvature portion 33, some pair of support points 41, 43 always exist on positively curved supporting surfaces ranging in curvature from that like a person's thigh to that like a person's upper body. The leg is adjustable in length and orientation so that the leg can provide a third support point for optimum stability.

The leg shown has three sections which telescope and which are locked in position by locking collars 28 and 29. As best seen in FIG. 4 the attachment end 24 of the leg is attached to a clevis joint 25 by a pin 84 through the arms 82 of the clevis joint. The clevis joint is rotatably attached by a bolt 83 (FIG. 3) headed on the work surface. Thus the leg can rotate 64 about the normal axis 61 and can rotate about an axis 27 along the pin 84. As the work surface is oriented—for example by rotations 64, 65, and 66 about the three orthogonal axes 61, 62, and 63—the leg 21 can be rotated about two orthogonal axes 64 and 27, and can be adjusted in length, to provide a third point of support to stably support the book holder.

A high friction leg footer 74 is shown in FIG. 7. The leg footer is a rectangular block with an indented portion 75 into which the leg foot end 22 can be placed. There is a layer of material with very high coefficient of friction 77 attached to the rectangular block so that when the leg footer is placed on a slippery surface the leg footer will not slide and thus the leg foot end 22 in the indentation 75 will not slide. Hook-and-loop fastener straps 76 are attached to the leg footer so that the leg footer can also be attached to other places such as a wheelchair foot rest 79 (FIG. 1) to provide a secure place 75 to support the leg foot end.

FIG. 2 shows how the inflected curvature makes the supportable edge 16 supportable on a wide range of curved surfaces, and FIG. 5 emphasizes this. At the midpoint 32 the supportable edge has negative curvature, at the inflection point 101 to the left of the midpoint the supportable edge inflects to a left positive curvature portion 31, and at the inflection point 102 to the right of the midpoint the supportable edge inflects to a right positive curvature portion 33. FIG. 2 shows that the supportable edge can inflect again to form an unessential, left decorative pedestal portion as the supportable edge meets the left edge 13, and shows that the supportable edge can inflect again to form an unessential, right decorative pedestal portion as the supportable edge meets the right edge 15. These second left and right inflection points are shown as points 103 and 104 in FIG. 5. Point 103 is at the left edge when the unessential, left decorative pedestal portion is absent, and point 104 is at the right edge when the unessential, right decorative pedestal portion is absent. The left positive curvature portion 31 is the portion between inflection points 101 and 103 and the right positive curvature portion 33 is the portion between inflection points 102 and 104.

A surface with circular cross section of radius 113 can support the supportable edge at the tangent points 111 and 112, and alternatively a surface with a larger circular cross section of radius 123 can support the supportable edge at the tangent points 121 and 122. The distance 124 between the pair of support points 121 and 122 provided by the larger radius cross section is greater than the distance 114 between the pair of support points 111 and 112 provided by the smaller radius cross section. The pair of support points 111 and 112, and alternatively the pair of support points 121 and 122, are equivalent to the pair of support points 41 and 43 in FIG. 2.

Because the supportable edge 16 has inflected curvature with a left positive curvature portion 31 and a right positive curvature portion 33, and because the leg is adjustable in length and orientation, the book holder is stably supportable on a surface with small radius of curvature such as a person's thigh and is even more stably supportable on a surface with a large radius of curvature such as a person's upper body. At any of these locations the book holder can be oriented over a wide range by rotations about the three orthogonal axes 61, 62, 63, also because of the positive curvature portions and because the leg is adjustable in orientation and length.

A shelf 71 is attached to the work surface 11 of the book holder. The shelf extends along the lateral axis and projects along the normal axis for holding a book and other similar matter on the book holder. Elastic straps 72 extend along the work surface long axis, pass through slots 87, and extend along the back surface long axis. The slots extend along the lateral axis so that the position of the straps along the lateral axis can be adjusted to accommodate small books and large books. The straps extend along the long axis 63 to below the shelf, the shelf being attached so that there is space between the shelf and the work surface where the straps pass. To be held, a book is placed open on the work surface with the bottom of the book on the shelf whereupon the straps are placed over most of the right half and over most of the left half of the book as can be seen in FIG. 1.

Pages of the book which are not held under the straps can be held by branches of a ligament angling across the work surface. A left branch of the ligament 91 is attached at the back surface, passes through a left lower hole 92 to the work surface, angles rightward, and passes through a left upper hole 93 to the back surface. A right branch of the ligament 94 is attached at the back surface, passes through a right lower hole 95, angles leftward, and passes through a right upper hole 96. The left and right ligament branches join where they pass through a hole 97 in a weight 98 hanging behind a weight cover 99 attached to the back surface. The ligament branches can hold several book pages open, and pages can be turned by taking a page out from under one ligament branch and putting the page under the other ligament branch. The weight provides constant, gentle holding force making it easy for a person to turn pages using a mouth stick and alternatively with a commercial page turner.

Another embodiment of the book holder is shown in FIG. 6. The elements in this embodiment 11', 12', 13', 14', 15', 16', 31', 32', 33', 71', 72', 91', and 94' are the equivalent to their unprimed counterparts 11, 12, 13, 14, 15, 16, 31, 32, 33, 71, 72, 91, and 94 in the preferred embodiment, except that the length of the work surface 11' along the lateral axis is greater than this length of the work surface 11 in the preferred embodiment. This wide book holder has two legs, a first leg 21' attached 83' near the left edge 13', and a second leg 21" attached 83" near the right edge 15'. These legs 21' and 21" and the clevis joint attachments 25' and 25" are otherwise just like the leg 21 and the clevis joint attachment 25 in the preferred embodiment.

On the embodiment shown in FIG. 6 an overlay 73', supported by the shelf 71', covers most of the straps 72' and the ligament branches 91', 94' in order to provide a smooth surface for writing, drawing, and other similar activities. An overlay, which is identical to 73' except in size, is used on the preferred embodiment. Material with very high coefficient of friction attached along the supportable edge 16' is shown here. This material is also used in the preferred embodiment. The preferred high-friction material is also resilient and cushions support forces.

FIG. 8 shows how the book holder can be used by a person in a standing position. Here a tie left branch 151 and a tie right branch 152 are attached to the back surface 12. The tie branches are removably fastened 153 around the person's body 154 to aid in supporting the supportable edge 16. This aids the stability of the work surface even when the book holder is used in sitting, reclining, and prone positions, especially if the user experiences spasmodic motions. The tie branches could equivalently be attached to the work surface 11, though the back surface is preferred because the tie branches can be fastened there out of the way when not in use.

Other equivalent attachments to the work surface, such as cushions and devices to hold goods used with the book holder, will be obvious hereafter to persons skilled in the art. For example, a small computer can be attached to the work surface using hook-and-loop fasteners attached to the work surface and complementary hook-and-loop fasteners attached to the computer. With a computer thus attached and with the tie branches tied about a person's body, the person can walk about making observations, stop, and position the leg to place the computer in position for input.

Other equivalent forms for the book holder and other equivalent forms for the supportable edge, the leg, the weighted ligament branches, the adjustable straps, the shelf, the leg footer,and the overlay will be obvious hereafter to persons skilled in the art. It is understood therefore that this invention is not limited to the particular examples illustrated here.

I claim:

1. A book holder comprising:

a work surface, the work surface having a back surface, the work surface and the back surface being bounded by a common periphery, the periphery having a left edge, a top edge, a right edge, and a supportable edge, the work surface having a long axis, a lateral axis, and a normal axis, the supportable edge having a midpoint and having an inflected curvature, the inflected curvature being negative curvature at the midpoint, the inflected curvature inflecting to a left positive curvature portion to the left of the midpoint, and the inflected curvature inflecting to a right positive curvature portion to the right of the midpoint; and a leg, the leg having a leg attachment end, a leg foot end, and a leg length, the leg length being the straight line distance between the leg attachment end and the leg foot end, the leg attachment end being attached to the back surface so that the leg can rotate independently about two orthogonal axes, the leg foot end being supportable on an external footing surface.

2. The book holder of claim 1 wherein the leg length is adjustable.

3. The book holder of claim 2 wherein a shelf is attached to the work surface for holding objects on the work surface, the shelf extending along the lateral axis and the shelf projecting along the normal axis.

4. The book holder of claim 3 wherein a strap is attached to the work surface, the strap extending along the work surface long axis with the position of the strap along the work surface lateral axis being adjustable, the strap for holding objects on the work surface.

5. The book holder of claim 4 wherein a ligament is attached to the work surface for holding objects on the work surface.

6. The book holder of claim 5 wherein a weight is attached to the ligament for maintaining the ligament at constant tension.

7. The book holder of claim 6 further comprising an overlay which is removably held on the work surface by the shelf so that the overlay covers the strap and the ligament to provide a smooth surface.

8. The book holder of claim 6 further comprising a leg footer which can be supported on the external footing surface, the leg footer having a very high coefficient of friction relative to the external footing surface, the leg footer having an indentation which can securely support the leg foot end, and the leg footer being removably attachable to a wheelchair foot rest.

9. The book holder of claim 5 wherein the supportable edge has a high coefficient of friction.

10. The book holder of claim 5 wherein the supportable edge is resilient to cushion supporting forces.

11. The book holder of claim 5 further comprising a second leg, the second leg having a second leg attachment end, a second leg foot end, and a second leg length, the second leg length being the straight line distance between the second leg attachment end and the second leg foot end, the second leg length being adjustable, the second leg attachment end being attached to the back surface so that the second leg can rotate independently about two orthogonal axes, the second leg foot end being supportable on the external footing surface.

12. The book holder of claim 2 further comprising a left tie branch attached to the back surface and a right tie branch attached to the back surface so that the left tie branch and the right tie branch can be removably fastened around a person's body.

13. A book holder comprising:

a work surface, the work surface having a back surface, the work surface and the back surface being bounded by a common periphery, the periphery having a left edge, a top edge, a right edge, and a supportable edge, the work surface having a long axis, a lateral axis, and a normal axis, the supportable edge having a midpoint and having an inflected curvature, the inflected curvature being negative curvature at the midpoint, the inflected curvature inflecting to a left positive curvature portion to the left of the midpoint, and the inflected curvature inflecting to a right positive curvature portion to the right of the midpoint, the supportable edge having a high coefficient of friction and the supportable edge being resilient to cushion supporting forces;

a leg, the leg having a leg attachment end, a leg foot end, and a leg length, the leg length being the straight line distance between the leg attachment end and the leg foot end, the leg length being adjustable, the leg attachment end being attached to the back surface so that the leg can rotate independently about two orthogonal axes, the leg foot end being supportable on an external footing surface;

a shelf attached to the work surface for holding objects on the work surface, the shelf extending along the lateral axis and the shelf projecting along the normal axis;

a strap attached to the work surface, the strap extending along the work surface long axis with the position of the strap along the work surface lateral axis being adjustable, the strap for holding objects on the work surface;

a ligament attached to the work surface for holding objects on the work surface;

a weight attached to the ligament for maintaining the ligament at constant tension;

an overlay which is removably held on the work surface by the shelf so that the overlay covers the strap and the ligament to provide a smooth surface;

a leg footer which can be supported on the external footing surface, the leg footer having a very high coefficient of friction relative to the external footing surface, the leg footer having an indentation which can securely support the leg foot end, and the leg footer being removably attachable to a wheelchair foot rest; and a left tie branch attached to the back surface and a right tie branch attached to the back surface so that the left tie branch and the right tie branch can be removably fastened around a person's body.

14. A book holder comprising:

a work surface, the work surface having a back surface, the work surface and the back surface being bounded by a common periphery, the periphery having a left edge, a top edge, a right edge, and a supportable edge, the work surface having a long axis, a lateral axis, and a normal axis, the supportable edge having a midpoint and having an inflected curvature, the inflected curvature being negative curvature at the midpoint, the inflected curvature inflecting to a left positive curvature portion to the left of the midpoint, and the inflected curvature inflecting to a right positive curvature portion to the right of the midpoint, the supportable edge having a high coefficient of friction and the supportable edge being resilient to cushion supporting forces;

a leg, the leg having a leg attachment end, a leg foot end, and a leg length, the leg length being the straight line distance between the leg attachment end and the leg foot end, the leg length being adjustable, the leg attachment end being attached to the back surface so that the leg can rotate independently about two orthogonal axes, the leg foot end being supportable on an external footing surface;

a second leg, the second leg having a second leg attachment end, a second leg foot end, and a second leg length, the second leg length being the straight line distance between the second leg attachment end and the second leg foot end, the second leg length being adjustable, the second leg attachment end being attached to the back surface so that the second leg can rotate independently about two orthogonal axes, the second leg foot end being supportable on the external footing surface;

a shelf attached to the work surface for holding objects on the work surface, the shelf extending along the lateral axis and the shelf projecting along the normal axis;

a strap attached to the work surface, the strap extending along the work surface long axis with the position of the strap along the work surface lateral axis being adjustable, the strap for holding objects on the work surface;

a ligament attached to the work surface for holding objects on the work surface;

a weight attached to the ligament for maintaining the ligament at constant tension;

an overlay which is removably held on the work surface by the shelf so that the overlay covers the strap and the ligament to provide a smooth surface;

a leg footer which can be supported on the external footing surface, the leg footer having a very high coefficient of friction relative to the external footing surface, the leg footer having an indentation which can securely support the leg foot end, and the leg footer being removably attachable to a wheelchair foot rest; and a left tie branch attached to the back surface and a right tie branch attached to the back surface so that the left tie branch and the right tie branch can be removably fastened around a person's body.

* * * * *